US010317825B2

(12) United States Patent
Iesaki

(10) Patent No.: US 10,317,825 B2
(45) Date of Patent: Jun. 11, 2019

(54) IMAGE FORMATION APPARATUS, CONTROL METHOD, AND MEDIUM STORING PROGRAM

(71) Applicant: BROTHER KOGYO KABUSHIKI KAISHA, Nagoya-shi, Aichi-ken (JP)

(72) Inventor: Kenichi Iesaki, Ichinomiya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/822,383

(22) Filed: Nov. 27, 2017

(65) Prior Publication Data

US 2018/0150003 A1 May 31, 2018

(30) Foreign Application Priority Data

Nov. 25, 2016 (JP) ..... 2016-229499

(51) Int. Cl.
*G03G 15/00* (2006.01)
*G03G 15/20* (2006.01)

(52) U.S. Cl.
CPC ..... *G03G 15/2039* (2013.01); *G03G 15/5004* (2013.01)

(58) Field of Classification Search
CPC ..... G03G 15/2039; G03G 15/2078; G03G 15/5004
USPC ..... 399/69
See application file for complete search history.

(56) References Cited

U.S. PATENT DOCUMENTS

2002/0003970 A1* 1/2002 Goto ..... G03G 15/2039 399/69
2009/0297199 A1 12/2009 Yamashina et al.
2016/0327889 A1* 11/2016 Shiki ..... G03G 15/2039

FOREIGN PATENT DOCUMENTS

| | | | |
|---|---|---|---|
| GB | 2108730 | A | 5/1983 |
| JP | S58-38972 | A | 3/1983 |
| JP | S60-163102 | A | 8/1985 |
| JP | H09-258601 | A | 10/1997 |
| JP | H11-282308 | A | 10/1999 |
| JP | 2004-070041 | A | 3/2004 |
| JP | 2006-171480 | A | 6/2006 |
| JP | 2010-015130 | A | 1/2010 |

* cited by examiner

*Primary Examiner* — Sophia S Chen
(74) *Attorney, Agent, or Firm* — Scully, Scott, Murphy & Presser, P.C.

(57) ABSTRACT

An image formation apparatus includes a fixing device, a heater driver, and a controller. The fixing device includes: a heater; a heating member; and a temperature sensor which outputs a signal depending on a temperature of the heater or the heating member. When a target temperature of the heater or the heating member changes from a first target temperature to a second target temperature lower than the first target temperature and before a detection temperature becomes equal to or lower than a first switching temperature which is equal to or lower than the second target temperature, the controller sets control value of the heater by on/off control or proportional control. After the detection temperature becomes equal to or lower than the first switching temperature, the controller sets control value of the heater by proportional-integral control.

15 Claims, 6 Drawing Sheets

IMAGE FORMATION APPARATUS, CONTROL METHOD, AND MEDIUM STORING PROGRAM

CROSS REFERENCE TO RELATED APPLICATION

The present application claims priority from Japanese Patent Application No. 2016-229499 filed on Nov. 25, 2016, the disclosure of which is incorporated herein by reference in its entirety.

BACKGROUND

Field of the Invention:

The present invention relates to an image formation apparatus including a fixing device and a controller, a method for controlling the fixing device, and a medium storing a program that is to be executed on a computer controlling the fixing device.

Description of the Related Art:

Japanese Patent Application Laid-open No. 2006-171480 discloses a method for controlling a heater of a fixing device. Specifically, when a target temperature is raised from 150° C. to 180° C., temperature adjustment control is switched from PI control to P control to gradually increase the target temperature by 5° C. When a heater temperature reaches a switching temperature (165° C.), the temperature adjustment control is switched to the PI control to gradually raise the target temperature by 5° C. until the target temperature reaches 180° C.

SUMMARY

According to an aspect of the present teaching, there is provided an image formation apparatus which includes: a fixing device; a heater driver; and a controller. The fixing device includes: a heater; a heating member to be heated by the heater; and a temperature sensor which outputs a signal depending on a temperature of the heater or the heating member. The heater driver includes a power circuit which controls electric power supply to the heater based on control value of the heater. The controller includes an electric circuit and is configured to: obtain a detection temperature from the signal outputted from the temperature sensor; set the control value of the heater based on the detection temperature; and output the control value to the heater driver. In a case that a target temperature of the heater or the heating member changes from a first target temperature to a second target temperature which is lower than the first target temperature and before the detection temperature becomes equal to or lower than a first switching temperature which is equal to or lower than the second target temperature, the controller is configured to set control value by on/off control or proportional control using a deviation between the target temperature and the detection temperature. In a case that the target temperature of the heater or the heating member changes from the first target temperature to the second target temperature and after the detection temperature becomes equal to or lower than the first switching temperature, the controller is configured to set the control value by proportional-integral control using the deviation and an integral value of the deviation. In a case that the target temperature of the heater or the heating member is set to the first target temperature and the detection temperature is lower than the first target temperature and before the detection temperature becomes equal to or higher than a second switching temperature which is lower than the first target temperature, the controller is configured to set the control value by the on/off control or the proportional control using the deviation. In a case that the target temperature of the heater or the heating member is set to the first target temperature and the detection temperature is lower than the first target temperature and after the detection temperature becomes equal to or higher than the second switching temperature, the controller is configured to set the control value by the proportional-integral control using the deviation and the integral value of the deviation.

According to the present teaching, when the target temperature changes from the first target temperature to the second target temperature lower than the first target temperature and after the detection temperature becomes equal to or lower than the first switching temperature that is equal to or lower than the second target temperature, the control value of the heater is set by the proportional-integral control. This can prevent the integral value of the deviation from being minus. Thus, it is possible to reduce the undershoot after the detection temperature becomes equal to or lower than the first switching temperature. The present teaching is applicable to a method for controlling the image formation apparatus, a program for controlling the image formation apparatus, and a medium storing the program.

DESCRIPTION OF THE EMBODIMENTS

Figure 1:
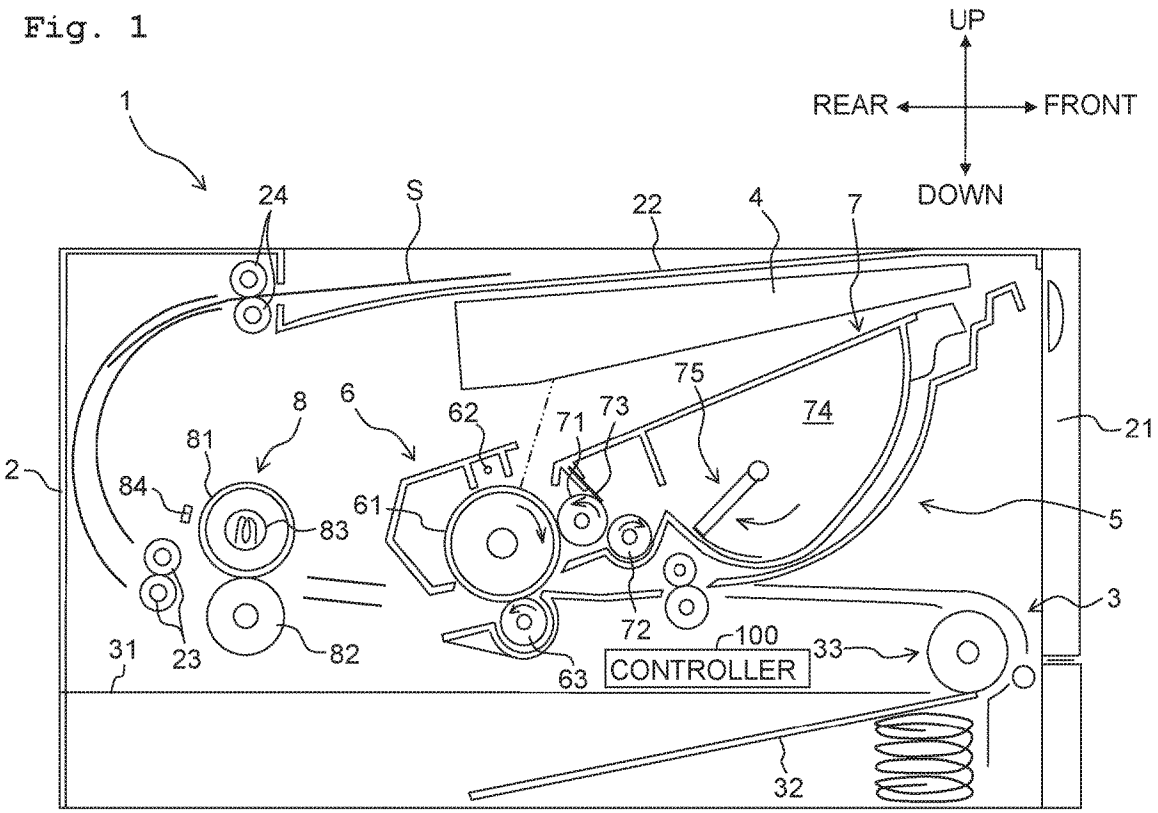
FIG. 1 depicts a schematic configuration of an image formation apparatus according to an embodiment of the present teaching.

Referring to the drawings, an embodiment of the present teaching is described below in detail. In the following explanation, directions are defined on the basis of a user who uses an image formation apparatus. Namely, a right side in FIG. 1 is defined as a "front", a left side in FIG. 1 is defined as a "rear", a near side in FIG. 1 is a "left", and a far side in FIG. 1 is defined as a "right". An up-down direction in FIG. 1 is defined as "up and down".

As depicted in FIG. 1, a laser printer 1, which is an exemplary image formation apparatus, mainly includes a body casing 2, a sheet feeder 3, an exposure unit 4, a process cartridge 5, a fixing device 8, and a controller 100.

The sheet feeder 3, which is disposed at a lower portion in the body casing 2, mainly includes a feed tray 31, a pressure plate 32, and a feed mechanism 33. The pressure plate 32 raises sheets S loaded in the feed tray 31 and the feed mechanism 33 supplies each sheet S to a space between a photosensitive drum 61 and a transfer roller 63 of the process cartridge 5.

The exposure unit 4, which is disposed at an upper portion in the body casing 2, includes a light source, a polygon mirror, a lens, a reflecting mirror, and the like (those of which are not depicted in the drawings). In the exposure unit 4, a light beam (see an alternate long and two short dashes line in FIG. 1) that is emitted from the light source on the basis of image data is scanned on a surface of the photosensitive drum 61 at high speed to expose the surface of the photosensitive drum 61.

The process cartridge 5 is disposed below the exposure unit 4. The process cartridge 5 is removably attached to the body casing 2 through a front-side opening, which appears when a front cover 21 of the body casing 2 provided on the front side is open. The process cartridge 5 includes a drum unit 6 and a developing cartridge 7.

The drum unit 6 mainly includes the photosensitive drum 61, a charging unit 62, and the transfer roller 63. The developing cartridge 7 is removably attached to the drum unit 6, and mainly includes a developing roller 71, a supply roller 72, a layer-thickness regulating blade 73, a storage part 74 storing a toner, and an agitator 75.

In the process cartridge 5, the surface of the photosensitive drum 61 is uniformly charged by the charging unit 62, then is exposed with the light beam from the exposure unit 4 to form an electrostatic latent image based on image data on the photosensitive drum 61. The toner in the storage part 74 is supplied to the supply roller 72 while being agitated by the agitator 75, and then supplied from the supply roller 72 to the developing roller 71. The toner enters between the developing roller 71 and the layer-thickness regulating blade 73 with rotation of the developing roller 71, and is carried, as a thin layer having a certain thickness, on the developing roller 71.

The toner carried on the developing roller 71 is supplied to the electrostatic latent image formed on the photosensitive drum 61. This visualizes the electrostatic latent image (the electrostatic latent image is made as a visual image), and a toner image is formed on the photosensitive drum 61. Allowing the sheet S to pass between the photosensitive drum 61 and the transfer roller 63 transfers the toner image formed on the photosensitive drum 61 onto the sheet S.

The fixing device 8, which is disposed on a rear side of the process cartridge 5, mainly includes a heating roller 81 as an exemplary heating member, a pressure roller 82, a halogen lamp 83 as an exemplary heater, and a thermistor 84 as an exemplary temperature sensor.

The heating roller 81 is a cylindrical member made of metal, includes the halogen lamp 83 therein, and is configured to be heated by the halogen lamp 83. The pressure roller 82 is a member having an elastic layer around a core metal. The pressure roller 82 is provided in pressure contact with the heating roller 81.

In the fixing device 8, the toner image transferred on the sheet S is thermally fixed during a period during which the sheet S passes between the heating roller 81 and the pressure roller 82. The sheet S to which the toner image has been thermally fixed is discharged on the discharge tray 22 by conveyance rollers 23 and 24.

Figure 2:
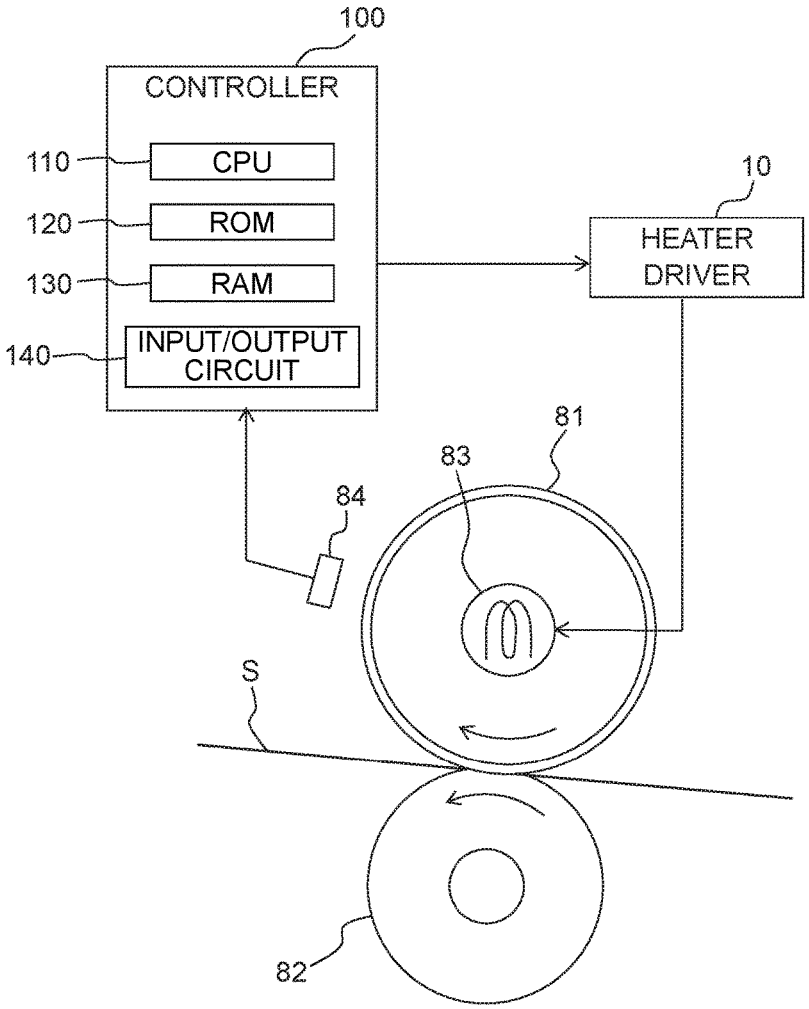
FIG. 2 depicts a configuration for controlling a fixing device.

The controller 100 controls respective parts or components of the laser printer 1, such as the fixing device 8. The controller 100 includes a single electric circuit or multiple electric circuits. Specifically, as depicted in FIG. 2, the controller 100 includes a CPU 110, a ROM 120, a RAM 130, an input/output circuit 140, and the like.

The ROM 120 stores programs controlling the respective parts of the laser printer 1 and data including a variety of setting information. The RAM 130 is used as a working area for the CPU 110 that performs each of the programs or a storage area in which data is temporarily stored. The CPU 110 performs a variety of arithmetic processing based on signals output from a variety of sensors such as the thermistor 84, programs and data read, for example, from the ROM 120, and the like.

The controller 100 outputs a control signal to each part of the laser printer 1 based on the arithmetic result of the CPU 110, thus controlling each part of the laser printer 1. In other words, each part of the laser printer 1 is configured to operate or act in response to the control signal output from the controller 100.

The thermistor 84 is a sensor that outputs, to the controller 100, a signal depending on a temperature of the heating roller 81. The thermistor 84 is disposed to face a surface of the heating roller 81 with a predefined space therebetween. The controller 100 obtains a detection value (detection temperature T) of a surface temperature of the heating roller 81 from the signal output from the thermistor 84.

When controlling the fixing device 8, the controller 100 sets control value U of the halogen lamp 83 and outputs the control value U set, to a heater driver 10. The heater driver 10 is a power circuit that controls power supply to the halogen lamp 83 based on a duty ratio, which is determined from the control value U set by the controller 100.

The controller 100 sets a target temperature TT of the heating roller 81, and sets the control value U of the halogen lamp 83 so that the detection temperature T obtained from the signal output from the thermistor 84 follows the target temperature TT.

Specifically, when the target temperature TT has been set to a first target temperature TT1 and the detection temperature T is lower than the first target temperature TT1, and before the detection temperature T becomes equal to or higher than a switching temperature TS1, the controller 100 sets the control value U of the halogen lamp 83 by proportional control using a deviation TT-T (hereinafter referred also to as "ΔT") between the target temperature TT (TT1) and the detection temperature T.

Specifically, the controller 100 calculates the control value U of the halogen lamp 83 by control in which proportional action for changing the control value U in proportion to the deviation ΔT is performed but integral action for changing the control value U in proportional to an integral value I of the deviation ΔT is not performed. In other words, the controller 100 sets the control value U of the halogen lamp 83 by so-called P control.

In this embodiment, the controller 100 sets the control value U of the halogen lamp 83 following the equation (1) described below by use of a proportional gain $K_p$ set in advance.

$$U=K_p(TT-T) \tag{1}$$

The switching temperature TS1 is set to a temperature lower than the first target temperature TT1. The switching temperature TS1 is previously set through experiment, simulation, or the like to correspond to the first target temperature TT1. Specifically, the switching temperature TS1 is set to a value that does not make overshoot too large. The large overshoot may be caused by rapid temperature increase in the heating roller 81 when the target temperature TT is set to a high temperature (i.e., the first target temperature TT1).

When the target temperature TT has been set to the first target temperature TT1 and the detection temperature T is lower than the first target temperature TT1, and after the detection temperature T becomes equal to or higher than the switching temperature TS1, the controller 100 sets the control value U of the halogen lamp 83 by proportional-integral control using the deviation ΔT and the integral value I of the deviation ΔT.

Specifically, the controller 100 calculates the control value U of the halogen lamp 83 by control in which both the proportional action and the integral action are performed. In other words, the controller 100 sets the control value U of the halogen lamp 83 by so-called PI control.

In this embodiment, the controller 100 sets the control value U of the halogen lamp 83 following the equations (2) and (3) by use of the proportional gain $K_p$ and an integration gain $K_i$ set in advance, $$U=K_p(TT-T)+K_iI \tag{2}$$

$$I_n=I_{n-1}+Ts(TT_n-T_n) \tag{3}$$

wherein, n put after each variable indicates that the variable is a current value, n−1 indicates that the variable is a previous value. Ts indicates a time interval of sampling.

When the target temperature TT has been updated from the first target temperature TT1 to the second target temperature TT2, and before the detection temperature T becomes equal to or lower than a switching temperature TS2, the controller 100 sets the control value U of the halogen lamp 83 by proportional control using a deviation ΔT between the target temperature TT (TT2) and the detection temperature T.

Specifically, the controller 100 calculates the control value U of the halogen lamp 83 by the control (P control) in which the proportional action is performed but the integral action is not performed. In this embodiment, the controller 100 sets the control value U of the halogen lump 83 following the above equation (1).

The second target temperature TT2 is set to a temperature that is lower than the first target temperature TT1. The switching temperature TS2 is set to a temperature that is equal to or lower than the second target temperature TT2. In this embodiment, the second target temperature TT2 is the same as the switching temperature TS2.

The first target temperature TT1, the switching temperature TS1, the second target temperature TT2, and the switching temperature TS2 are set to satisfy the equation (4) described below.

$$TT1-TS1>TT2-TS2 \tag{4}$$

When the target temperature TT has been changed from the first target temperature TT1 to the second target temperature TT2, more specifically, when the target temperature TT has been updated, the controller 100 resets the integral value I of the deviation ΔT calculated so far to a predefined value. In this embodiment, the predefined value is zero.

When the target temperature TT has been changed from the first target temperature TT1 to the second target temperature TT2, and after the detection temperature T becomes equal to or lower than the switching temperature TS2 (the second target temperature TT2), the controller 100 sets the control value U of the halogen lamp 83 by proportional-integral control using the deviation ΔT and the integral value I of the deviation ΔT.

Specifically, the controller 100 calculates the control value U of the halogen lamp 83 by performing the control (PI control) in which both the proportional action and the integral action are performed. In this embodiment, the controller 100 sets the control value U of the halogen lump 83 following the above equations (2) and (3).

When the target temperature TT has been updated to make the integral value I of the deviation ΔT zero, the controller 100 sets a flag FI to zero. When the flag FI is set to one, the controller 100 calculates the integral value I of the deviation ΔT. When the flag FI is set to zero, the controller 100 stops the calculation of the integral value I. When the target temperature TT has been set to the first target temperature TT1, and when the detection temperature T is lower than the first target temperature TT1 and becomes equal to or higher than the switching temperature TS1, the controller 100 performs the integral action. In that case, the controller 100 sets the flag FI to one. When the target temperature TT has been updated from the first target temperature TT1 to the second target temperature TT2, and when the detection temperature T is equal to or lower than the switching temperature TS2, the controller 100 performs the integral action. In that case, the controller 100 sets the flag FI to one. An initial value of the flag FI is zero.

Subsequently, operation of the controller 100 (a method for controlling the fixing device 8) is described below with reference to the flowchart of FIG. 3 and the timing diagram of FIG. 4.

Figure 3:
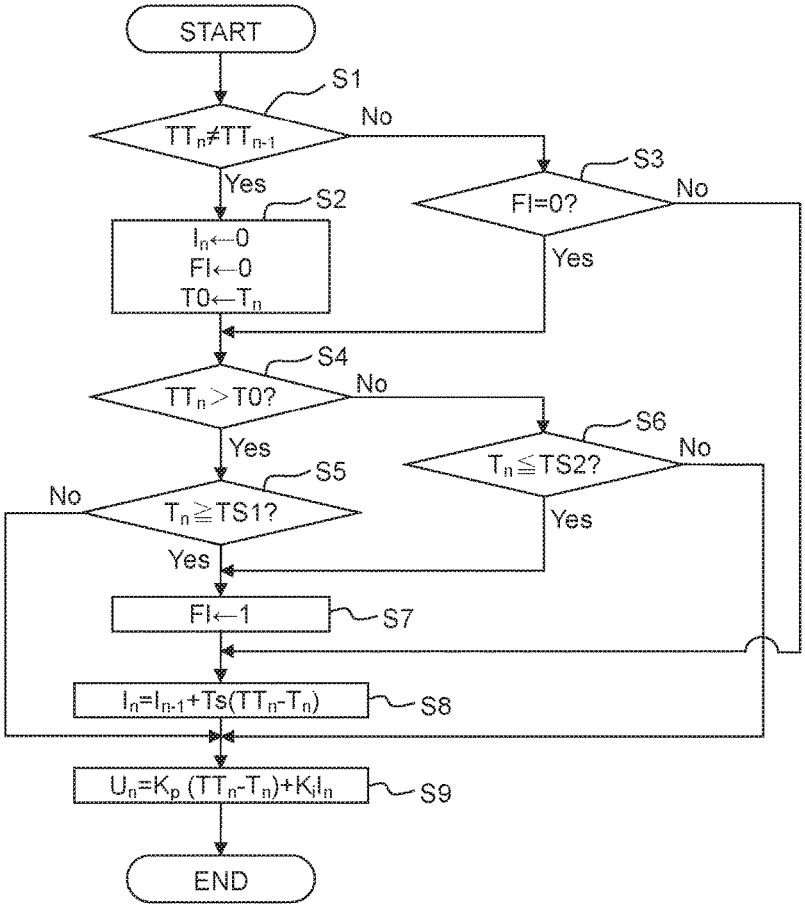
FIG. 3 is a flowchart indicating operation of a controller.
Figure 4:
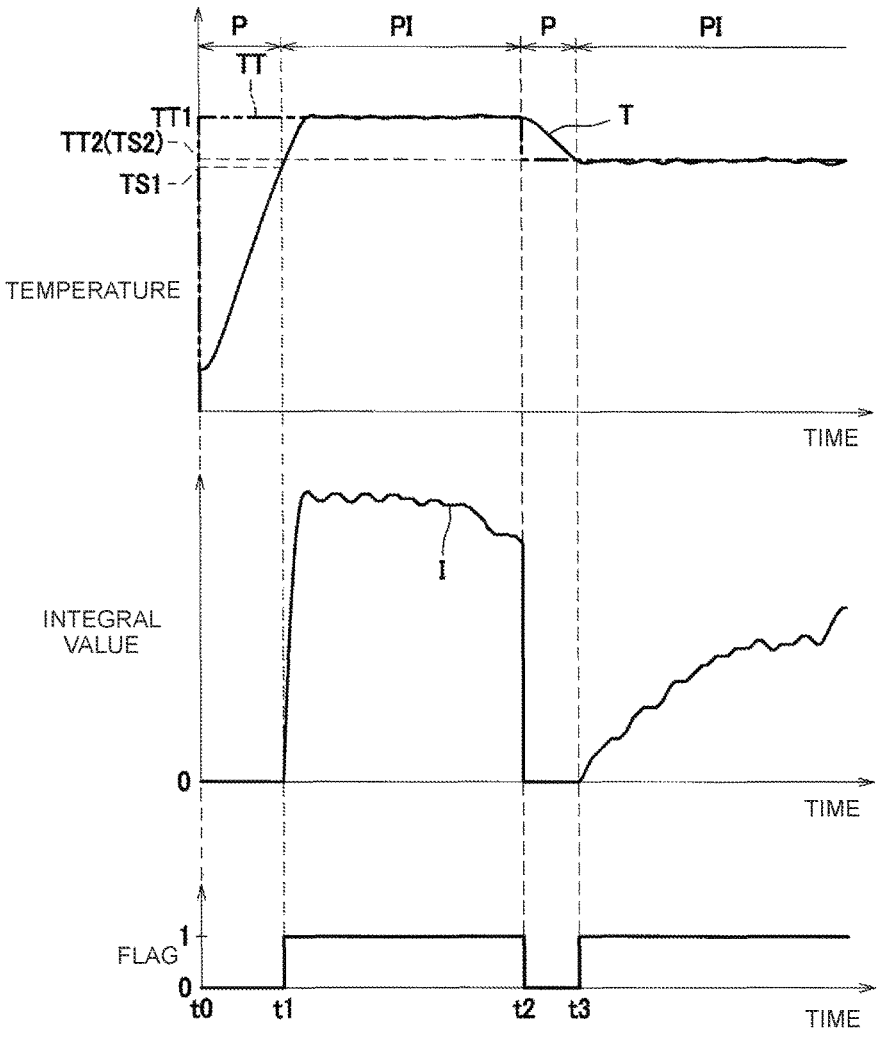
FIG. 4 is a timing diagram indicating changes of a target temperature, a detection temperature, an integral value of a deviation between the target temperature and the detection temperature, and a flag, depending on operation of the controller.

As depicted in FIGS. 3 and 4, when, at a time t0, the target temperature TT has been set to the first target temperature TT1 and the target temperature $TT_n$ is different from the target temperature $TT_{n-1}$ (S1: Yes), the controller 100 resets the integral value $I_n$ to zero, and sets the flag FI to zero. Further, the controller 100 sets a detection temperature $T_n$ at that time, that is, the detection temperature T at the time of setting the first target temperature TT1, to an updated temperature TO, and stores the updated temperature TO (S2).

After the step S2, the controller 100 determines whether the target temperature $TT_n$ is higher than the updated temperature TO (S4). The target temperature $TT_n$ is higher than the updated temperature TO when the target temperature TT has been set to the first target temperature TT1 at the time t0 (S4: Yes). Thus, the controller 100 determines whether the detection temperature $T_n$ is equal to or higher than the switching temperature TS1 (S5).

Since the detection temperature $T_n$ is lower than the switching temperature TS1 at the time t0 (S5: No), the controller 100 sets the control value $U_n$ of the halogen lamp 83 in a step S9. In that situation, since the integral value $I_n$ is zero, the controller 100 sets the control value $U_n$ of the halogen lamp 83 by the P control (the equation (1)), and outputs the control value $U_n$ to the heater driver 10.

The target temperature TT is not updated between the time t0 and a time t1, and the target temperature $TT_n$ is the same as the target temperature $TT_{n-1}$ (S1: No). Thus, the controller 100 determines in a step S3 whether the flag FI is set to zero. Since the flag FI is set to zero between the time t0 and the time t1 (S3: Yes), the controller 100 proceeds to a step S5 via a step S4. Further, since the detection temperature $T_n$ is lower than the switching temperature TS1 (S5: No), the controller 100 sets the control value $U_n$ of the halogen lamp 83 by the P control in the step S9. Then, the controller 100 outputs the control value $U_n$ to the heater driver 10.

When the detection temperature $T_n$ becomes equal to or higher than the switching temperature TS1 at the time t1 in the step S5 (S5: Yes), the controller 100 sets the flag F1 to one (S7) and calculates the integral value $I_n$ of the deviation ΔT between the target temperature $TT_n$ and the detection temperature $T_n$ (S8). Since the integral value $I_n$ is not zero at the time t1, the controller 100 sets the control value $U_n$ of the halogen lamp 83 by the PI control (the equation (2)) and then outputs the control value $U_n$ to the heater driver 10 (S9).

Since the target temperature TT is not updated between the time t1 and a time t2 (S1: No), the controller 100 executes the step S3. Since the flag F1 is set to one between the time t1 and the time t2 (S3: No), the controller 100 calculates the integral value $I_n$ in a step S8, sets the control value $U_n$ of the halogen lamp 83 by the PI control, and outputs the control value $U_n$ to the heater driver 10 (S9).

The target temperature $TT_n$ is different from the target temperature $TT_{n-1}$ (S1: Yes) when the target temperature TT has been updated from the first target temperature TT1 to the second target temperature TT2 at the time t2. Thus, the controller 100 makes the integral value $I_n$ calculated so far zero, sets the flag F1 to zero, sets the temperature $T_n$ at that time, that is, the detection temperature T at the time of updating the target temperature TT from the first target temperature TT1 to the second target temperature TT2, to another updated temperature TO, and stores the another updated temperature TO (S2).

After the step S2, the controller 100 executes the step S4. When the target temperature TT has been updated to the second target temperature TT2 at the time t2, the target temperature $TT_n$ is equal to or lower than the updated temperature TO (S4: No). Thus, the controller 100 determines whether the detection temperature $T_n$ is equal to or lower than the switching temperature TS2 (S6).

Since the detection temperature $T_n$ is higher than the switching temperature TS2 at the time t2 (S6: No), the controller 100 sets the control value $U_n$ of the halogen lump 83 in the step S9. In that situation, since the integral value $I_n$ is zero, the controller 100 sets the control value $U_n$ of the halogen lamp 83 by the P control and outputs the control value $U_n$ to the heater driver 10. In a section in which the detection temperature $T_n$ is higher than the target temperature TT, a proportional ($K_p$ (TT−T)) is a minus, which makes the control value $U_n$ a minus. When the control value $U_n$ is a minus, the heater driver 10 performs the same control as the case in which the control value $U_n$ is zero, namely, the heater driver 10 controls the power supply to the halogen lamp 83 in a state where the duty ratio is 0%. Specifically, the halogen lamp 83 is turned off.

The target temperature TT is not updated between the time t2 and a time t3 (S1: No), and thus the controller 100 executes the step S3. Since the flag FI is set to zero (S3: Yes), the controller 100 executes a step S6 after the step S4. Since the detection temperature $T_n$ is higher than the switching temperature TS2 between the time t2 and the time t3 (S6: No), the controller 100 sets the control value $U_n$ of the halogen lamp 83 by the P control in the step S9. Then, the controller 100 outputs the control value $U_n$ to the heater driver 10.

When the detection temperature $T_n$ becomes equal to or lower than the switching temperature TS2 at the time t3 in the step S6 (S6: Yes), the controller 100 sets the flag F1 to one (S7) and calculates the integral value $I_n$ (S8). Since the integral value $I_n$ is not zero at the time t3, the controller 100 sets the control value $U_n$ of the halogen lamp 83 by the PI control and outputs the control value $U_n$ to the heater driver 10 (S9).

Since the target temperature TT is not updated after the time t3 in FIG. 4 (S1: No), the controller 100 executes the step S3. Since the flag FI is set to one (S3: No), the controller 100 calculates the integral value $I_n$ in the step S8, sets the control value $U_n$ of the halogen lamp 83 by the PI control, and outputs the control value $U_n$ to the heater driver 10 (S9).

In this embodiment described above, as depicted in FIG. 5, when the target temperature TT has been updated from the first target temperature TT1 to the second target temperature TT2 that is lower than the first target temperature TT1, and after the detection temperature T becomes equal to or lower than the switching temperature TS2, the PI control is started to set the control value U of the halogen lamp 83. When comparing this embodiment and a case in which the PI control is started at a temperature higher than the switching temperature TS2, the embodiment can prevent the integral value I of the deviation ΔT from being minus. This reduces the undershoot after the detection temperature T becomes equal to or lower than the switching temperature TS2.

The first target temperature TT1, the switching temperature TS1, the second target temperature TT2, and the switching temperature TS2 satisfy the relation TT1−TS1>TT2−TS. In other words, the difference between the second target temperature TT2 and the switching temperature TS2 is smaller than the difference between the first target temperature TT1 and the switching temperature TS1. Thus, the PI control can be started to set the control value U of the halogen lamp 83 in a state where the deviation ΔT between the second target temperature TT2 and the detection temperature T is small. This shortens the time required for the detection temperature T to stabilize at the target temperature TT2.

When the target temperature TT has been updated from the first target temperature TT1 to the second target temperature TT2, the integral value I of the deviation ΔT is set to a predefined value (specifically, zero). Thus, when the PI control is started after the detection temperature T becomes equal to or lower than the switching temperature TS2, it is possible to prevent the integral value I of the deviation ΔT from being too large. This shortens the time required for the detection temperature T to stabilize at the second target temperature TT2.

Although the embodiment of the present teaching is described above, the present teaching is not limited to the above embodiment. The above configurations may be changed appropriately as described below without departing from the gist and/or scope of the present teaching.

Figure 6:
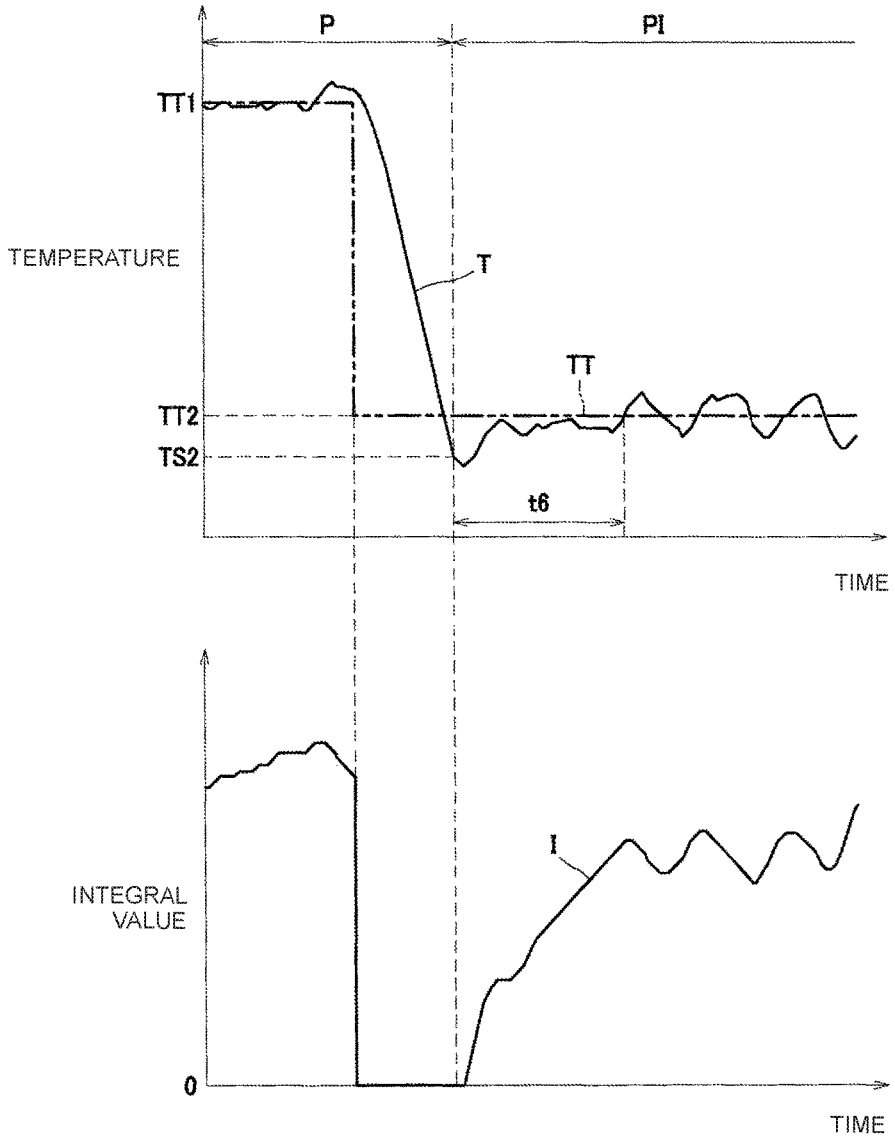
FIG. 6 is a timing diagram indicating changes of the target temperature, the detection temperature, and the integral value of the deviation, when the switching temperature is lower than the second target temperature.

For example, in the above embodiment, the switching temperature TS2 is equal to the second target temperature TT2. The present teaching, however, is not limited thereto. The switching temperature TS2 may be lower than the second target temperature TT2. In that case, as depicted in FIG. 6, when the target temperature TT has been updated from the first target temperature TT1 to the second target temperature TT2, and after the detection temperature T becomes lower than the second target temperature TT2 and becomes equal to or lower than the switching temperature TS2, the PI control is started.

When the P control (proportional control) is continued as is after the target temperature TT has been updated from the first target temperature TT1 to the second target temperature TT2, assuming that a minimum temperature for the first undershoot where the detection temperature T is lower than the second target temperature TT2 is $T_{min}$, the switching temperature TS2 lower than the second target temperature TT2 is set to a temperature higher than the minimum temperature $T_{min}$.

Figure 5:
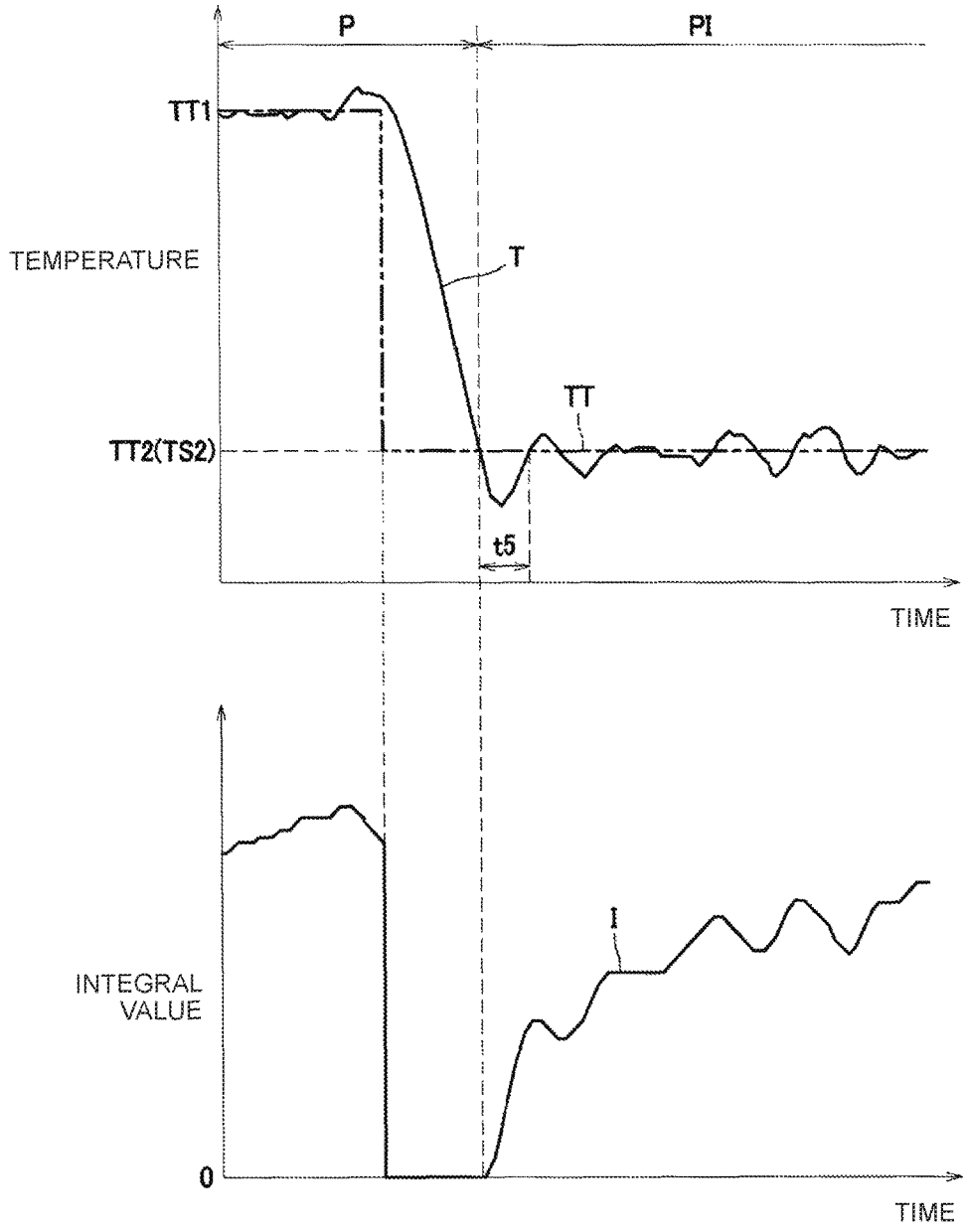
FIG. 5 is a timing diagram indicating changes of the target temperature, the detection temperature, and the integral value of the deviation, when a switching temperature is equal to a second target temperature.

In the above embodiment, the second target temperature TT2 and the switching temperature TS2 have the same temperature. This makes it possible to start the PI control in the state where the deviation ΔT between the second target temperature TT2 and the detection temperature T is smaller than the case in which the switching temperature TS2 is lower than the second target temperature TT2. As a result, as depicted in FIG. 5, a time t5 elapsing after the PI control is started in the state where TT2=TS2 and before the detection temperature T reaches the second target temperature TT2, is shorter than a time t6 elapsing after the PI control is started in the state where TT2>TS2 before the detection temperature T reaches the second target temperature TT2.

The detection temperature T reaching the second target temperature TT2 stabilizes at the second target temperature TT2. Therefore, by setting the second target temperature TT2 and the switching temperature TS2 to the same temperature, it is possible to shorten the time for the detection temperature T to stabilize at the target temperature TT2.

In the above embodiment, the integral value I of the deviation ΔT is reset to zero as the predefined value, when the target temperature TT has been updated from the first target temperature TT1 to the second target temperature TT2. The present teaching, however, is not limited thereto. For example, the predefined value may be any other value than zero. Or, when the target temperature has been updated, the integral value of the deviation between the target temperature and the detection temperature may be kept as is without being reset to the predefined value. When the next proportional-integral control is started, the integral value kept may be used to set the control value of the halogen lamp.

In the above embodiment, the "proportional control" of the present teaching is exemplified by the P control. The present teaching, however, is not limited thereto. For example, the proportional control of the present teaching may be so-called PD control that performs the proportional action and differential action that changes the control value in proportion to a differential value of the deviation between the target temperature and the detection temperature. In the above embodiment, the "proportional-integral control" of the present teaching is exemplified by the so-called PI control. The present teaching, however, is not limited thereto. For example, the proportional-integral control of the present teaching may be so-called PID control that performs the proportional action, the integral action, and the differential action.

When the target temperature TT is set to the first target temperature TT1, when the temperature of the heating roller 81 is increasing in the state where the detection temperature T is lower than the first target temperature TT1, and before the detection temperature T becomes equal to or higher than the switching temperature TS1, the control value of the halogen lamp 83 may be set by on/off control instead of the proportional control. For example, the power supply to the halogen lamp 83 may be controlled in a state where the duty ratio is fixed to 10%.

When the temperature of the heating roller 81 is decreasing after the target temperature TT is updated from the first target temperature TT1 to the second target temperature TT2, and before the detection temperature T becomes equal to or lower than the switching temperature TS2, the control value of the halogen lamp 83 may be set by the on/off control instead of the proportional control. For example, the power supply to the halogen lamp 83 may be controlled by setting the control value of the halogen lamp 83 to zero. Specifically, the halogen lamp 83 may be turned off.

In the above embodiment, the thermistor 84 as the temperature sensor outputs a signal depending on a temperature of the heating roller 81. The present teaching, however, is not limited thereto. For example, the temperature sensor may be disposed to face the pressure roller and may output a signal depending on a temperature of the pressure roller to which heat is transmitted from the heating roller. This allows the temperature sensor to indirectly detect the temperature of the heating roller via the pressure roller. The temperature sensor may be any other sensor than the thermistor. The temperature sensor may be a non-contact type temperature sensor or a contact-type temperature sensor.

The temperature sensor may be disposed to directly face the heater, provided that the temperature sensor outputs a signal depending on a temperature of the heater. Namely, the temperature sensor may directly detect the temperature of the heater that is a control object of the controller. When the temperature sensor directly detects the temperature of the heater, control value of the heater may be set as follows. Namely, a target temperature of the heater is set, and then the control value of the heater is set so that the detection temperature of the temperature sensor follows the target temperature.

In the above embodiment, the heating roller 81 is an exemplary heating member. The present teaching, however, is not limited thereto. For example, the heating member may be an endless fixing belt provided in a fixing device of a belt-fixing type. In the above embodiment, the fixing device 8 includes the pressure roller 82, namely, the roller-like pressure member. The present teaching, however, is not limited thereto. For example, the fixing device 8 may include a belt-like pressure member.

In the above embodiment, the halogen lamp 83 using radiation heat is an exemplary heater. The present teaching, however, is not limited thereto. The heater may be a ceramic heater or a carbon heater using heat of a resistor. Or, the heater may be, for example, an IH heater that inductively heats the heating member. The heater may be disposed outside the heating member instead of being disposed inside the heating member.

In the above embodiment, the laser printer 1 that forms a monochrome image on the sheet S is an exemplary image formation apparatus. The present teaching, however, is not limited thereto. The image formation apparatus may be, for example, a printer configured to form a color image on a sheet. The image formation apparatus is not limited to the printers. For example, the image formation apparatus may be, for example, a copy machine or a multifunction peripheral provided with a document reader, such as a flatbed scanner.

The present teaching may be achieved not only as the image formation apparatus, but also as a program that causes the image formation apparatus to execute processing. The program may be provided by being recorded in a non-transitory recording medium. The non-transitory recording medium may include, for example, a CD-ROM, DVD-ROM, and a storage part placed in a server that is connectable to the image formation apparatus via a communication network. The program stored in the storage part of the server may be distributed as information or a signal indicating the program through the communication network such as the internet.

The elements described in the embodiment and the modified embodiments may be used in any combination.

What is claimed is:

1. An image formation apparatus, comprising:

a fixing device including: a heater; a heating member to be heated by the heater; and a temperature sensor configured to output a signal depending on a temperature of the heater or the heating member;

a heater driver including a power circuit which controls electric power supply to the heater based on control value of the heater; and a controller including an electric circuit, the controller being configured to: obtain a detection temperature from the signal outputted from the temperature sensor; set the control value of the heater based on the detection temperature; and output the control value to the heater driver;

in a case that a target temperature of the heater or the heating member changes from a first target temperature to a second target temperature which is lower than the first target temperature and before the detection temperature becomes equal to or lower than a first switching temperature which is equal to or lower than the second target temperature, the controller is configured to set control value by on/off control or proportional control using a deviation between the target temperature and the detection temperature, in a case that the target temperature of the heater or the heating member changes from the first target temperature to the second target temperature and after the detection temperature becomes equal to or lower than the first switching temperature, the controller is configured to set control value by proportional-integral control using the deviation and an integral value of the deviation, and the controller is configured to change the integral value to a predefined value.

2. The image formation apparatus according to claim 1, wherein, in a case that the target temperature of the heater or the heating member is set to the first target temperature and the detection temperature is lower than the first target temperature and before the detection temperature becomes equal to or higher than a second switching temperature which is lower than the first target temperature, the controller is configured to set the control value by the on/off control or the proportional control using the deviation, and in a case that the target temperature of the heater or the heating member is set to the first target temperature and the detection temperature is lower than the first target temperature and after the detection temperature becomes equal to or higher than the second switching temperature, the controller is configured to set the control value by the proportional-integral control using the deviation and the integral value of the deviation.

3. The image formation apparatus according to claim 2, wherein, in a case that the first target temperature is TT1, the second target temperature is TT2, the first switching temperature is TS2, and the second switching temperature is TS1, a relation TT1−TS1>TT2−TS2 is satisfied.

4. The image formation apparatus according to claim 3, wherein the first switching temperature is equal to the second target temperature.

5. The image formation apparatus according to claim 1, wherein the predefined value is zero.

6. A method for controlling a fixing device, the method comprising:

setting control value of a heater included in the fixing device by on/off control or proportional control using a deviation between a target temperature of the heater or a heating member heated by the heater and a detection temperature obtained from a signal outputted from a temperature sensor configured to detect a temperature of the heater or the heating member, in a case that the target temperature of the heater or the heating member changes from a first target temperature to a second target temperature which is lower than the first target temperature and before the detection temperature becomes equal to or lower than a first switching temperature which is equal to or lower than the second target temperature, and setting the control value of the heater by proportional-integral control using the deviation and an integral value of the deviation, wherein the integral value is changed to a predefined value in a case that the target temperature of the heater or the heating member changes from the first target temperature to the second target temperature and after the detection temperature becomes equal to or lower than the first switching temperature.

7. The method according to claim 6, further comprising:

setting control value of the heater by the on/off control or the proportional control using the deviation, in a case that the target temperature of the heater or the heating member is set to the first target temperature and the detection temperature is lower than the first target temperature and before the detection temperature becomes equal to or higher than a second switching temperature which is lower than the first target temperature; and setting the control value of the heater by the proportional-integral control using the deviation and the integral value of the deviation, in a case that the target temperature of the heater or the heating member is set to the first target temperature and the detection temperature is lower than the first target temperature and after the detection temperature becomes equal to or higher than the second switching temperature.

8. The method according to claim 7, wherein, in a case that the first target temperature is TTI, the second target temperature is TT2, the first switching temperature is TS2, and the second switching temperature is TS1, a relation TTI−TS1>TT2−TS2 is satisfied.

9. The method according to claim 8, wherein the first switching temperature is equal to the second target temperature.

10. The method according to claim 6, wherein the predefined value is zero.

11. A non-transitory computer-readable medium storing a program executable by a computer configured to control a fixing device, the program causing the computer to execute:

setting control value of a heater included in the fixing device by on/off control or proportional control using a deviation between a target temperature of the heater or a heating member heated by the heater and a detection temperature obtained from a signal outputted from a temperature sensor configured to detect a temperature of the heater or the heating member, in a case that the target temperature of the heater or the heating member changes from a first target temperature to a second target temperature which is lower than the first target temperature and before the detection temperature becomes equal to or lower than a first switching temperature which is equal to or lower than the second target temperature, and setting the control value of the heater by proportional-integral control using the deviation and an integral value of the deviation, wherein the integral value is changed to a predefined value in a case that the target temperature of the heater or the heating member changes from the first target temperature to the second target temperature and after the detection temperature becomes equal to or lower than the first switching temperature.

12. The medium according to claim 11, wherein the program causes the computer to further execute:

setting the control value of the heater by the on/off control or the proportional control using the deviation, in a case that the target temperature of the heater or the heating member is set to the first target temperature and the detection temperature is lower than the first target temperature and before the detection temperature becomes equal to or higher than a second switching temperature which is lower than the first target temperature; and setting the control value of the heater by the proportional-integral control using the deviation and the integral value of the deviation, in a case that the target temperature of the heater or the heating member is set to the first target temperature and the detection temperature is lower than the first target temperature and after the detection temperature becomes equal to or higher than the second switching temperature.

13. The medium according to claim 12, wherein, in a case that the first target temperature is TT1, the second target temperature is TT2, the first switching temperature is TS2, and the second switching temperature is TS1, a relation TT1−TS1>TT2−TS2 is satisfied.

14. The medium according to claim 13, wherein the first switching temperature is equal to the second target temperature.

15. The medium according to claim 11, wherein the predefined value is zero.

* * * * *